US008746958B2

(12) United States Patent
Spray

(10) Patent No.: US 8,746,958 B2
(45) Date of Patent: Jun. 10, 2014

(54) BEVERAGE CONTAINER

(76) Inventor: Michael Spray, Washoe Valley, NV (US)

( * ) Notice: Subject to any disclaimer, the term of this patent is extended or adjusted under 35 U.S.C. 154(b) by 108 days.

(21) Appl. No.: 13/448,241

(22) Filed: Apr. 16, 2012

(65) Prior Publication Data

US 2013/0272086 A1 Oct. 17, 2013

(51) Int. Cl.

| | |
|---|---|
| ***B01F 13/00*** | (2006.01) |
| ***B01F 5/06*** | (2006.01) |
| ***B65D 1/40*** | (2006.01) |
| ***B65D 3/28*** | (2006.01) |
| ***B65D 90/02*** | (2006.01) |

(52) U.S. Cl.
USPC ..... 366/130; 366/336; 366/337; 366/338; 366/339; 366/340; 220/734; 215/382; 215/385; 229/400

(58) Field of Classification Search
USPC ..... 215/382, 385; 229/400; 336/130, 336/336–340; 366/130, 336–340, 307; 220/734
See application file for complete search history.

(56) References Cited

U.S. PATENT DOCUMENTS

| | | | | |
|---|---|---|---|---|
| 3,138,371 | A * | 6/1964 | Feher et al. | 366/341 |
| 3,400,855 | A * | 9/1968 | Alexander | 220/719 |
| 4,253,772 | A * | 3/1981 | Burton-Smith | 366/130 |
| 4,880,312 | A * | 11/1989 | Carlson | 366/130 |
| 2011/0062225 | A1* | 3/2011 | Edvardsson | 229/400 |

* cited by examiner

*Primary Examiner* — Christopher K Vandeusen
(74) *Attorney, Agent, or Firm* — Mark A. Goodman, Esq.; Goodman Law Center

(57) ABSTRACT

A beverage container for mixing a beverage is disclosed. The beverage container includes a cup having a stirring flap integral to an internal side wall of the cup. The stifling flap has a sine wave shape and comprises a top fin protruding near the top of the internal wall and a bottom fin protruding near the bottom of the internal wall of the cup. The top fin and the bottom fin are separated by a central portion. The cup is swirled in a circular motion by a person's hand to mix the liquid contained within. The central portion allows liquid to pass freely through the middle of the cup to gain momentum when the cup is swirled. The bottom fin has the shape of a lower case letter 'h', to allow solid material gathered in the bottom of the cup to pass underneath the bottom fin and mix with liquid.

16 Claims, 5 Drawing Sheets

BEVERAGE CONTAINER

FIELD OF THE DISCLOSURE

The present disclosure relates generally to the field of mixing containers and methods for mixing liquids. More particularly, the present disclosure relates to an improved mixing container with an integrated stirring flap that provides for the easy mixing of liquids contained therein.

BACKGROUND

The beverage mixing process requires the use of a stirrer to mix the components of the beverage contained in the mixing container. Users are required to hold the drinking cup with one hand and stir the liquid using the other hand. Cups with self-contained spoons or paddles have been used by individuals for mixing liquids. These cups are typically designed with integrated stirrers or paddles to aid in an effective mixing process. These cups include a stirrer attached to the inner side of the cup that needs to be torn off by the user which can cause damage to the cup. The user must hold the cup in his hand and stir the liquid using the other hand. This type of mixing entails inconvenience to the user.

With existing mixing devices, the user has to repetitively stir the liquid. Repetitive stifling increases the potential for spillage which in turn causes difficulty to the user, even burning if the liquid is hot. Mixing cups may be made of paper, cardboard, foam, or plastic. The stirrer, spoon or paddle may be integrated within these mixing containers. The user must tear off the stirrer from these cups and use it for stirring. While tearing off the stirrer from the cups, the cups may be easily damaged. Some of the mixing devices make use of a spring-loaded stifling device which in turn makes the manufacture of the cup complex and expensive.

Some mixing devices incorporate a plate with fins on the bottom portion. After pouring liquid in the cup, the user must grasp the bottom portion and rotate the cup alternately in a clockwise and counter-clockwise direction until the sugar is dissolved. This type of cup is also difficult to manufacture. In addition, the user may find it difficult to continuously rotate the cup to dissolve the sugar.

Some conventional beverage mixing containers include a fluid mixer to be inserted into a mixing container. The container needs to be reciprocally rotated by the user so as to mix the liquid. The fluid mixer has a plurality of blades to move the fluid upwards and downwards upon reciprocal rotation of the container. This type of mixing is time-consuming and complex. The user often finds it difficult to remove the mixer from the container.

Therefore, there is a need for a simple liquid mixing container that allows the user to easily and safely mix the liquid within. As such, the container should be easy to manufacture. The needed container contains an integrated stifling flap that allows liquid to move easily within. The needed container eliminates the need for stirring continuously to effectively mix the liquid. The liquid would be easily and safely mixed when the user grasps the container and moves it in a circular motion. Finally, the needed container also incorporates a plurality of perforations that allows liquid to move simply and effectively without causing difficulty to the user.

SUMMARY OF PREFERRED EMBODIMENT OF THE DISCLOSURE

Advantages of One or More Embodiments of the Present Disclosure

The various embodiments of the present invention may, but do not necessarily, achieve one or more of the following advantages:

The ability to allow the user to easily and safely mix the liquid contained within.

The ability to provide a mixing container with an integral stifling flap having a plurality of perforations.

The ability to provide a container with a sine wave shaped stifling flap.

The ability to use a container that allows liquid to easily move within.

The ability to provide a container that is easy to manufacture.

The ability to mix the liquid easily by swirling the cup using user's hand.

The ability to provide a container made of disposable material.

The ability to allow a simple, convenient and ease of use to the user.

These and other advantages may be realized by reference to the remaining portions of the specification, claims, and abstract.

BRIEF DESCRIPTION OF PREFERRED EMBODIMENT OF THE PRESENT DISCLOSURE

In preferred embodiment, the present invention comprises a beverage container for mixing a beverage. The beverage container includes a cup having a stifling flap integral to an internal side wall of the cup. The stifling flap extends internally inside the cup. The stirring flap comprises a top fin protruding near the top of the internal wall and a bottom fin protruding near the bottom of the internal wall of the cup. The top fin and the bottom fin are separated by a central portion. The cup may be swirled in a circular motion by a person's hand to mix the liquid contained within. The central portion has minimal material so as to allow liquid to pass freely through the middle of the cup to gain momentum when the cup is swirled. The stirring flap has a sine wave shape with a rounded tip on the top fin. The rounded tip extends just below the surface of liquid contents of the cup when the cup is full, thereby causing the liquid contents to fold on to itself when the cup is swirled, thereby minimizing liquid from escaping the cup. The bottom fin has the shape of a lower case letter 'h', thereby allowing solid material that may gather in the bottom of the cup to pass underneath the bottom fin and mix with the liquid. The stirring flap is perforated and the stirring flap includes perforations. The perforations comprise a plurality of substantially circular holes. The top fin includes exactly 3 holes and the bottom fin also includes exactly 3 holes to allow liquid to pass and mix as the circular movement of liquid creates vortex inside the cup, when the cup is rotated in circular motion by a user.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT DISCLOSURE

Figure 1:
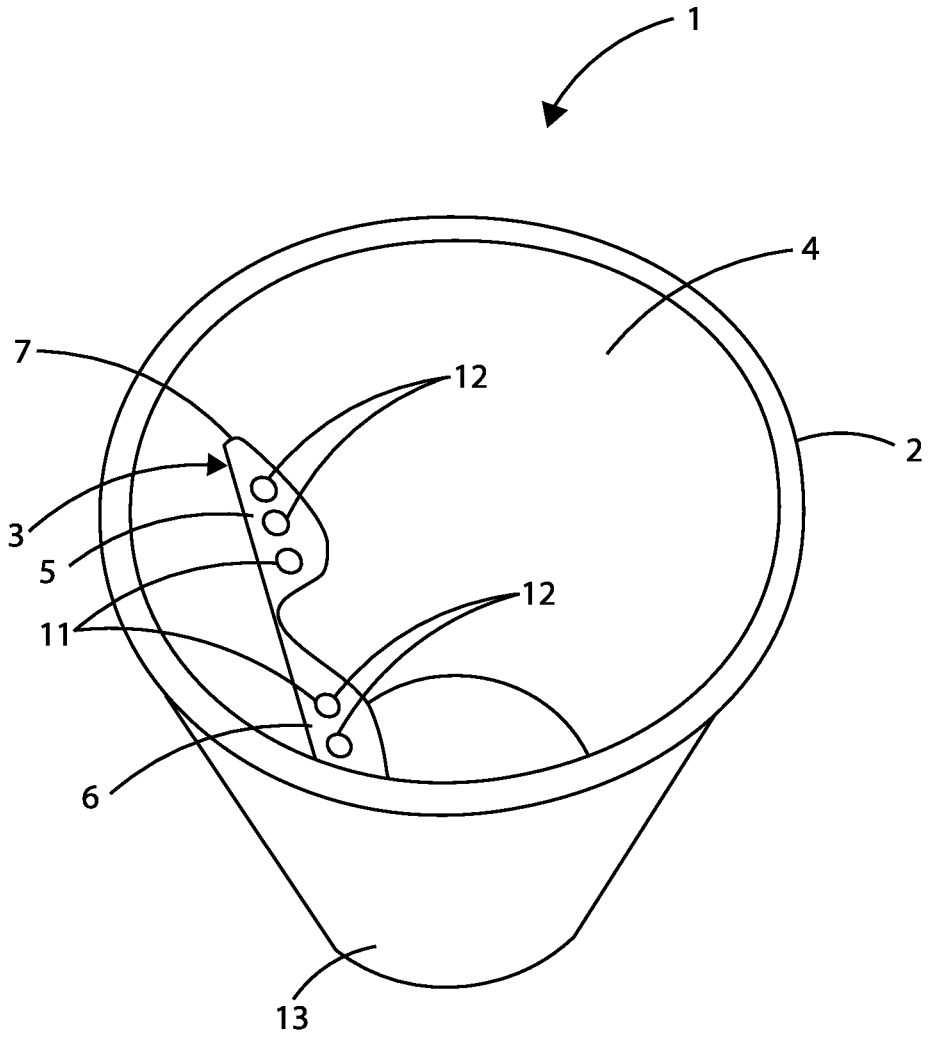
FIG. 1 is substantially a top perspective view of the preferred embodiment of the present invention.
Figure 2:
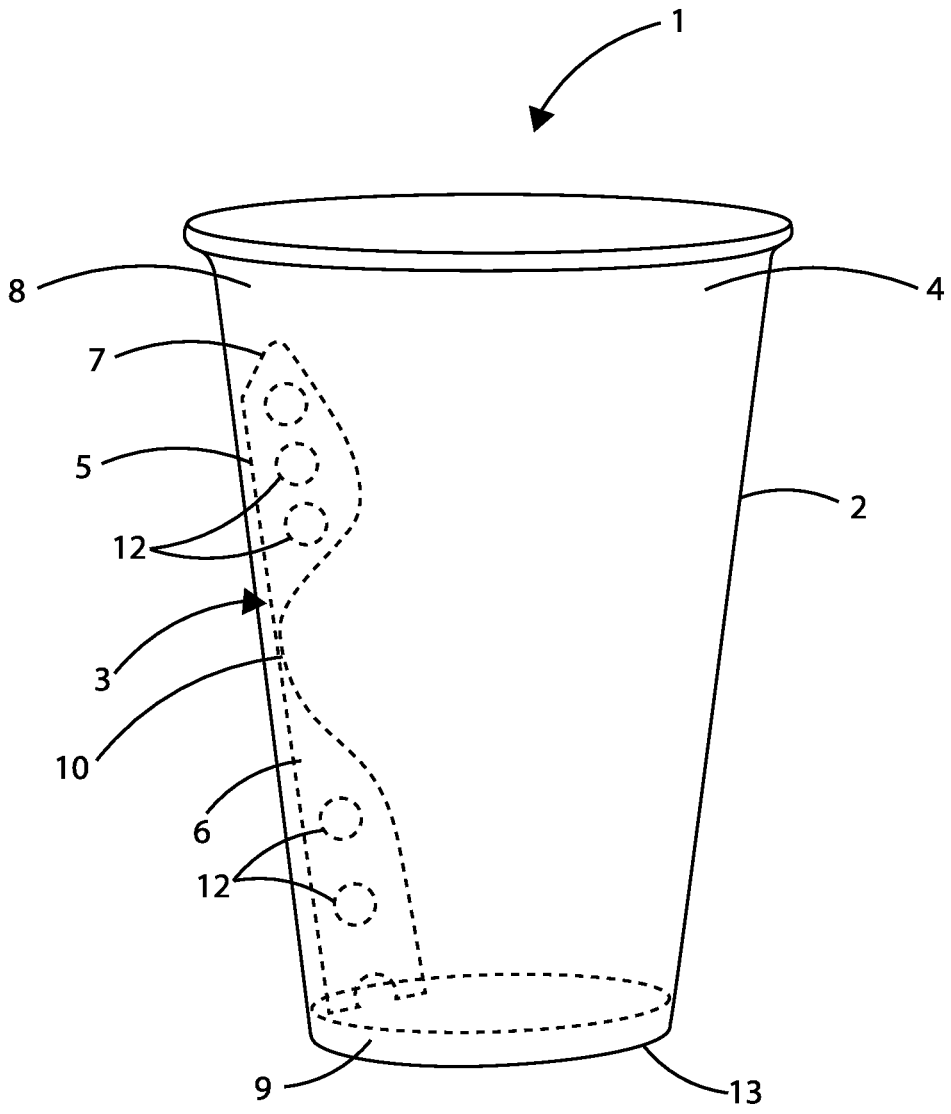
FIG. 2 is substantially a side perspective view of the preferred embodiment of the present invention.
Figure 3:
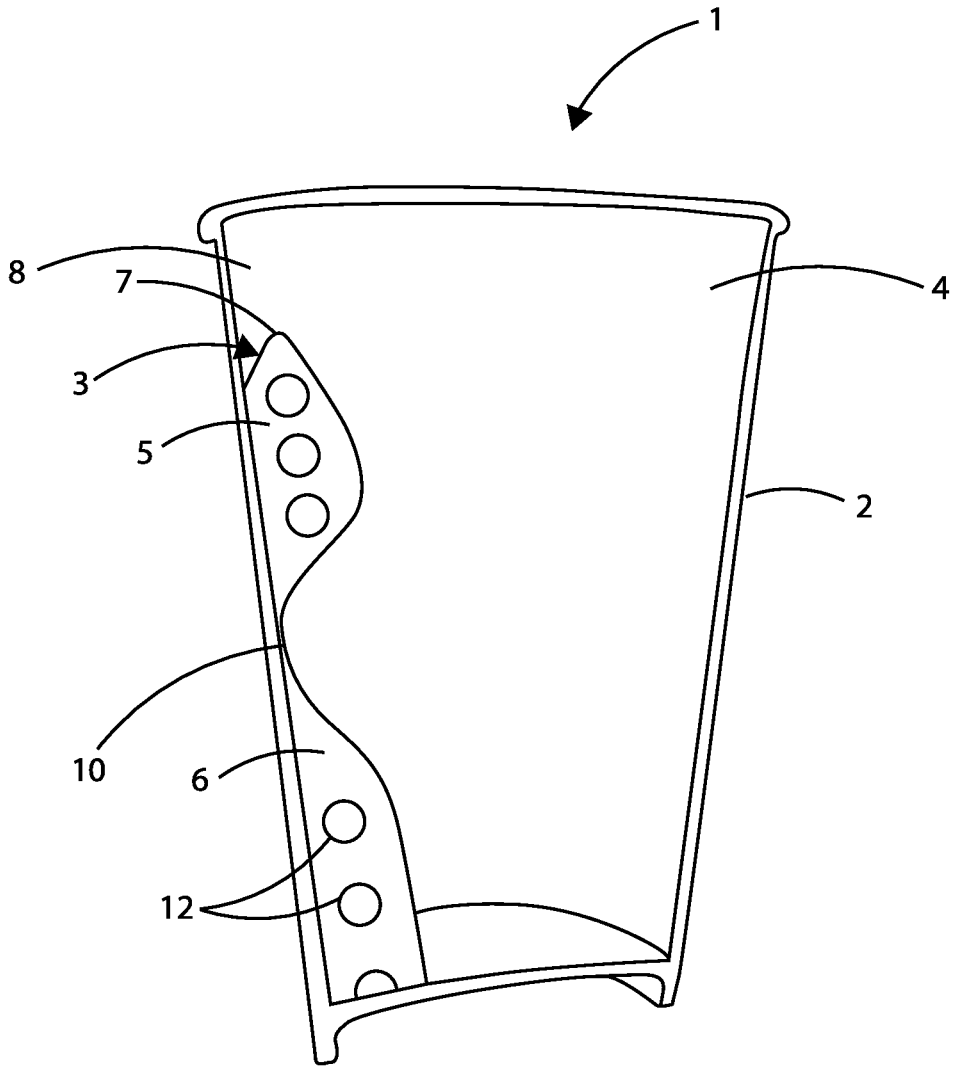
FIG. 3 is substantially a cross sectional view of the preferred embodiment of the present invention.
Figure 4:
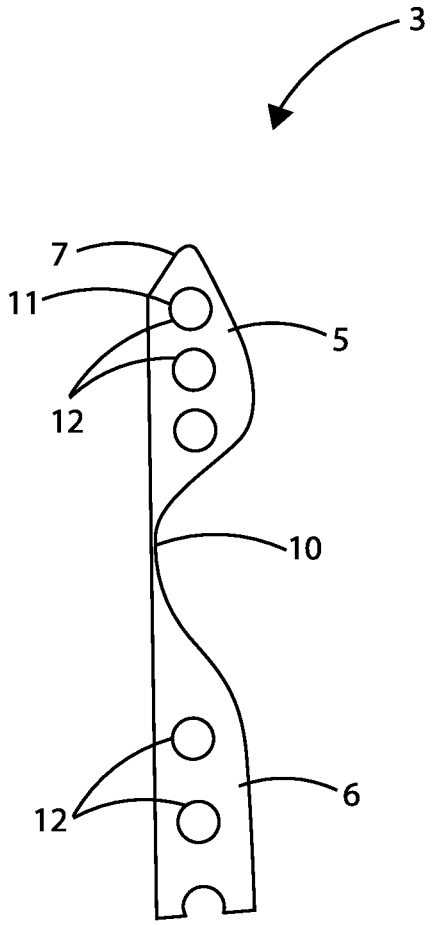
FIG. 4 is substantially a perspective view of a stirring flap of the present invention.
Figure 5:
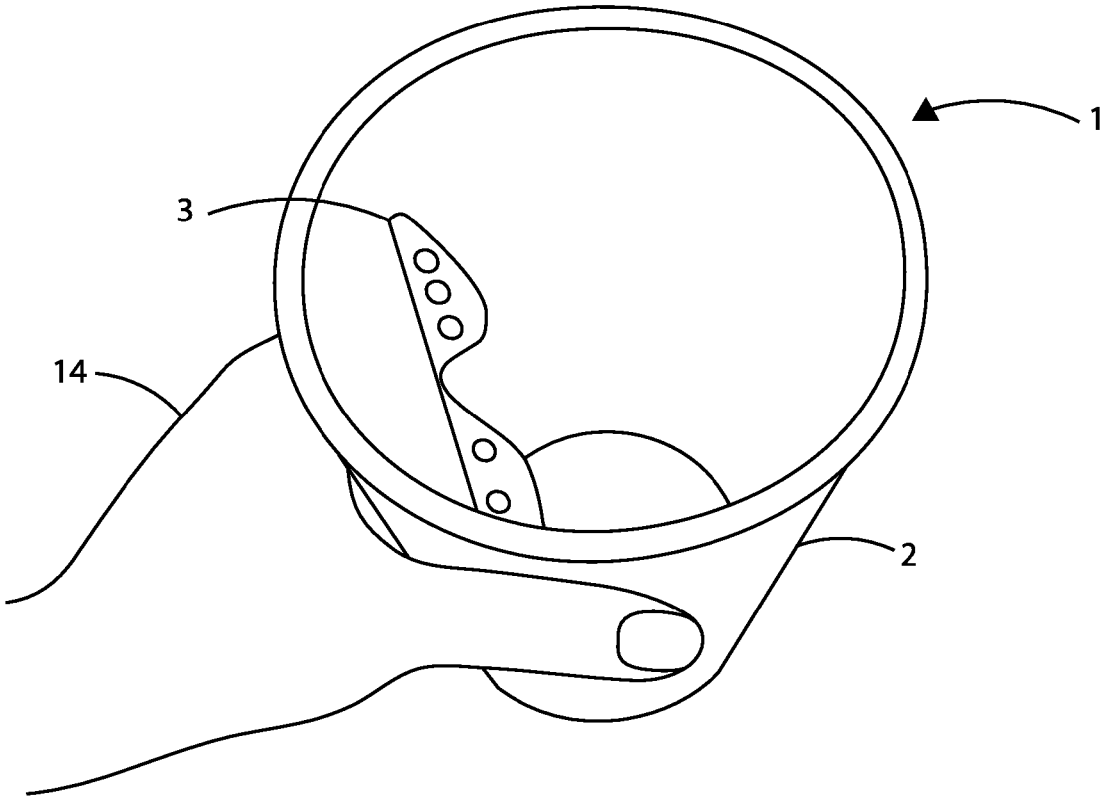
FIG. 5 is substantially a detailed illustration of the present invention in use.

In the following detailed description of the preferred embodiment, reference is made to the accompanying drawings, which from a part of this application. The drawings show, by way of illustration, specific embodiments in which the invention may be practiced. It is to be understood that other embodiments may be utilized and structural changes may be made without departing from the scope of the present invention.

The following is a listing of the reference numbers included in the original drawings and the element that each reference number corresponds to and a brief description:

1. Beverage Container. The beverage container 1 includes a cup 2 in accordance with the present invention.
2. Cup. This includes a stirring flap 3 integral to an internal side wall 4 of the cup.
3. Stirring flap. This includes a top fin 5 and a bottom fin 6.
4. Internal side wall. This is used to integrate the stifling flap 3 to the cup 2.
5. Top fin. The top fin 5 with a rounded tip 7 protrudes near a top 8 of the internal side wall 4.
6. Bottom fin. This protrudes near a bottom 9 of the internal side wall 4.
7. Rounded tip. This extends just below the surface of liquid contents of the cup 2.
8. Top of the internal side wall. This is near the protruded top fin 5.
9. Bottom of the internal side wall. This is near the protruded bottom fin 6.
10. A central portion. This is used to separate the top fin 5 and the bottom fin 6.
11. Perforations. This includes a plurality of substantially circular holes 12 in the stifling flap 3.
12. Plurality of substantially circular holes. The plurality of substantially circular holes 12 are included in the top fin 5 and the bottom fin 6.
13. Bottom of the cup. This is used to gather solid materials in the cup 2.
14. Person's hand. Person's hand 14 may be used to swirl the cup 2.

The present invention comprises a beverage container 1 for mixing a beverage. The beverage container 1 includes a cup 2 having a stifling flap 3 integral to an internal side wall 4 of the cup 2. The stifling flap 3 extends internally inside the cup 2. The stifling flap 3 comprises a top fin 5 protruding near the top of the internal wall 8 of the cup 2 and a bottom fin 6 protruding near the bottom of the internal wall 9 of the cup 2. The top fin 5 and the bottom fin 6 are separated by a central portion 10. The cup 2 may be swirled in a circular motion by a person's hand 14 to mix the liquid contained within. The central portion 10 has minimal material so as to allow liquid to pass freely through the middle of the cup 2 to gain momentum when the cup 2 is swirled.

The stifling flap 3 has a sine wave shape with a rounded tip 7 on the top fin 5. The rounded tip 7 extends just below the surface of liquid contents of the cup 2 when the cup 2 is full, thereby causing the liquid contents to fold on to itself when the cup 2 is swirled, thereby minimizing liquid from escaping the cup 2. The bottom fin 6 has the shape of a lower case letter 'h', thereby allowing solid material that may gather in the bottom of the cup 13 to pass underneath the bottom fin 6 and mix with the liquid. The stifling flap 3 is perforated and the stirring flap 3 includes perforations 11. The perforations 11 comprise a plurality of substantially circular holes 12, wherein each of the substantially circular holes 12 has a diameter between three sixteenths of an inch and six sixteenths of an inch. The top fin 5 includes exactly 3 holes 12 and the bottom fin 6 also includes exactly 3 holes 12 to allow liquid to pass and mix as the circular movement of liquid creates vortex inside the cup 2, when the cup 2 is rotated in circular motion by a user.

The beverage container 1 may be utilized for mixing liquids such as beverages. The cup 2 is made of disposable material selected from the group consisting of paper, cardboard, foam, and plastic and the stifling flap 3 comprises an extension of the disposable material that extends past a glue point of the cup 2. The top fin 5 and the bottom fin 6 are integral to the cup 2 as they are portions of the stirring flap 3 cut out of the same disposable material as of the cup 2.

As discussed in the background section, while mixing liquids, the user must rotate the mixing cup alternately in a clockwise and counter-clockwise direction until the sugar is dissolved which can cause difficulty to the user. The present invention provides the simple beverage container 1 that allows the user to easily and safely mix the liquid contained within. The container 1 is adapted for allowing the liquid to move simply and effectively without causing difficulty to the user.

The method may include providing the beverage container 1 to the user and swirling the beverage container 1 in a circular motion by the person's hand 14. The cup 2 is capable of being swirled by the person's hand 14. The rotational movement of a grasping hand 14 in a circular motion on the cup 2 will generate a circular moving liquid inside the cup 2 thereby creating a centrifugal force that pushes the liquid against the stirring flap 3 to effectively mix the liquid. While swirling, the rounded tip 7 of the sine wave shaped stirring flap 3 allows the liquid to fold on to itself thereby minimizing the liquid from escape from the cup 2. The 'h' shaped bottom fin 6 allows the solid material gathering at the bottom of the cup 13 to pass underneath the bottom fin 6 and mix with the liquid. This allows the solid material to mix effectively with the liquid. The substantially circular holes 12 on the top fin 5 and the bottom fin 6 allows the liquid to pass through and mix as the circular movement of the liquid creates vortex inside the cup 2 when the person's hand 14 moves up in a circular motion.

One of the main advantages of this container 1 is the integrated stifling flap 3 that allows the user to easily mix the liquid by swirling the cup 2 thereby providing a simple, convenient and ease of use. Another advantage of the present invention is that the 'h' shaped bottom fin 6 allows the solid material gathered at the bottom of the cup 2 to be easily mixed with the liquid.

In preferred embodiment, the present invention may be customized as an ideal liquid mixing device. The beverage container 1 may be easily manufactured with less number of components which makes it more economical. Further, the beverage container 1 may be easily swirled by the person's hand 14. Also, the container 1 is made of disposable material which makes it to be easily disposed by the user.

Although the description above contains many specifications, these should not be construed as limiting the scope of the invention but as merely providing illustrations of some of the embodiments of this invention. Thus, the scope of the invention should be determined by the appended claims and their legal equivalents rather than by the examples given.

What is claimed is:

1. A beverage container comprising:

a. a cup made of a material having a stirring flap integral to an internal side wall of the cup, the stirring flap extending internally;

b. the stirring flap comprises:

i. a top fin protruding near the top of the internal wall of the cup; the top fin having a top edge, a lateral edge and a bottom edge; wherein the top edge extends internally at an upward angle until it meets the lateral edge at an apex and, following the apex, the lateral edge extends downward until it meets the bottom edge; and ii. a bottom fin protruding near the bottom of the internal wall of the cup, the bottom fin having a top edge, a lateral edge and a bottom edge;

c. wherein the top fin and the bottom fin are separated by a central portion, the central portion comprising a recess thereby allowing liquid to pass freely through the middle of the cup to gain momentum when the cup is swirled;

d. wherein the stirring flap is constructed from the same material as the cup.

2. The beverage container of claim 1, wherein the top edge of the bottom fin and the bottom edge of the top fin together form a sine wave shape about the central portion and the apex comprises a rounded tip extending just below the surface of liquid contents of the cup when the cup is full thereby causing the liquid contents to fold on to itself when the cup is swirled thereby minimizing liquid from escaping the cup.

3. The beverage container of claim 1, wherein the bottom edge of the bottom fin has the shape of a lower case letter 'h' thereby allowing solid material that may gather in the bottom of the cup to pass underneath the bottom fin and mix with the liquid.

4. The beverage container of claim 1, wherein the stirring flap is perforated.

5. The beverage container of claim 1, wherein the top fin has exactly 3 holes.

6. The beverage container of claim 1, wherein the bottom fin has exactly 3 holes.

7. The beverage container of claim 4, wherein the perforations comprise a plurality of substantially circular holes, the substantially circular holes having a diameter between three sixteenths of an inch and six sixteenths of an inch.

8. The beverage container of claim 1, wherein the cup is made of disposable material selected from the group consisting of paper, cardboard, foam, and plastic, and the stirring flap comprises an extension of the disposable material that extends past a glue point of the cup.

9. A method of mixing a beverage comprising:

a. providing a beverage container, the beverage container comprising:

i. a cup made of a material having a stirring flap integral to an internal side wall of the cup wherein the stirring flap is constructed from the same material as the cup, the stirring flap extending internally;

ii. the stirring flap comprises a top fin protruding near the top of the internal wall of the cup; the top fin having a top edge, a lateral edge, and a bottom edge; wherein the top edge extends internally at an upward angle until it meets the lateral edge at an apex, wherein following the apex, the lateral edge extends downward until it meets the bottom edge; and a bottom fin protruding near the bottom of the internal wall of the cup, the bottom fin having a top edge, a lateral edge, and a bottom edge;

iii. wherein the top fin and the bottom fin are separated by a central portion, the central portion comprising a recess thereby allowing liquid to pass freely through the middle to gain momentum when the cup is swirled in a circular fashion;

b. swirling the beverage container in a circular motion.

10. The method of mixing a beverage of claim 9, wherein the cup is capable of being swirled by a person's hand.

11. The method of mixing a beverage of claim 9, wherein the stirring flap has a sine wave shape with a rounded tip the top fin, the rounded tip extends just below the surface of liquid contents of the cup when the cup is full thereby causing the liquid contents to fold on to itself when the cup is swirled thereby minimizing liquid from escaping the cup.

12. The method of mixing a beverage of claim 9, wherein the bottom fin has the shape of a lower case letter 'h' thereby allowing solid material that may gather in the bottom of the cup to pass underneath the bottom fin and mix with the liquid.

13. The method of mixing a beverage of claim 9, wherein the stirring flap is perforated.

14. The method of mixing a beverage of claim 9, wherein the top fin has exactly 3 holes.

15. The method of mixing a beverage of claim 9, wherein the perforations comprise a plurality of substantially circular holes, the substantially circular holes having a diameter between three sixteenths of an inch and six sixteenths of an inch.

16. The method of mixing a beverage of claim 13, wherein the cup is made of disposable material selected from the group consisting of paper, cardboard, foam, and plastic, and the stirring flap comprises an extension of the disposable material that extends past a glue point of the cup.

* * * * *